US007427909B2

(12) United States Patent
Ono et al.

(10) Patent No.: US 7,427,909 B2
(45) Date of Patent: Sep. 23, 2008

(54) COIL COMPONENT AND FABRICATION METHOD OF THE SAME

(75) Inventors: Kazuyuki Ono, Sendai (JP); Takashi Yanbe, Sendai (JP); Hatsuo Matsumoto, Sendai (JP)

(73) Assignees: Nec Tokin Corporation, Sendai-shi, Miyagi (JP); Denso Corporation, Kariya, Aichi-pref (JP)

( * ) Notice: Subject to any disclaimer, the term of this patent is extended or adjusted under 35 U.S.C. 154(b) by 0 days.

(21) Appl. No.: 10/866,612

(22) Filed: Jun. 10, 2004

(65) Prior Publication Data

US 2005/0012581 A1 Jan. 20, 2005

(30) Foreign Application Priority Data

| | | |
|---|---|---|
| Jun. 12, 2003 | (JP) | 2003-168055 |
| Jun. 17, 2003 | (JP) | 2003-172313 |
| Jun. 27, 2003 | (JP) | 2003-185303 |
| Aug. 6, 2003 | (JP) | 2003-206300 |
| Sep. 16, 2003 | (JP) | 2003-323673 |
| Oct. 21, 2003 | (JP) | 2003-360606 |
| Nov. 28, 2003 | (JP) | 2003-399664 |
| Feb. 10, 2004 | (JP) | 2004-033576 |
| Mar. 8, 2004 | (JP) | 2004-063989 |
| May 17, 2004 | (JP) | 2004-146858 |

(51) Int. Cl.
*H01F 27/02* (2006.01)

(52) U.S. Cl. ..... 336/90

(58) Field of Classification Search ..... 336/90
See application file for complete search history.

(56) References Cited

U.S. PATENT DOCUMENTS

| | | | | |
|---|---|---|---|---|
| 1,946,964 | A | 2/1934 | Cobb | |
| 1,982,689 | A | 12/1934 | Polydoroff | |
| 3,268,878 | A * | 8/1966 | Lohan | 360/122 |
| 4,227,166 | A | 10/1980 | Tsuji et al. | |
| 5,008,643 | A * | 4/1991 | Heritier-Best | 336/96 |
| 5,062,197 | A * | 11/1991 | Ngo et al. | 29/606 |
| 5,559,486 | A * | 9/1996 | Ikenoue et al. | 336/90 |
| 6,198,373 | B1 | 3/2001 | Ogawa et al. | |
| 6,392,525 | B1 | 5/2002 | Kato et al. | |
| 6,437,555 | B1 * | 8/2002 | Pioch et al. | 324/127 |
| 6,558,565 | B1 | 5/2003 | Matsutani et al. | |
| 6,788,185 | B2 | 9/2004 | Fujiwara et al. | |
| 6,791,445 | B2 * | 9/2004 | Shibata et al. | 336/90 |
| 6,940,382 | B2 * | 9/2005 | Ishikawa et al. | 336/90 |

(Continued)

FOREIGN PATENT DOCUMENTS

DE 37 43 222 A1 6/1989

(Continued)

*Primary Examiner*—Elvin Enad
*Assistant Examiner*—Joselito Baisa
(74) *Attorney, Agent, or Firm*—Frishauf, Holtz, Goodman & Chick, P.C.

(57) ABSTRACT

A coil component (100) comprising coil-containing insulator enclosure and a magnetic core (80). The coil-containing insulator enclosure is obtained by enclosing a coil (30), except for end portions (12, 22) of the coil (30), with an insulator (50), wherein the insulator (50) comprises at least a first resin. The magnetic core (80) is made of a mixture of a second resin (82) and powder, which comprises magnetic powder (84). The coil-containing insulator enclosure is embedded in the magnetic core (80).

54 Claims, 12 Drawing Sheets

U.S. PATENT DOCUMENTS

| | | | | |
|---|---|---|---|---|
| 7,132,019 | B2 | 11/2006 | Koshiba et al. | |
| 2002/0039667 | A1 | 4/2002 | Takaya et al. | |
| 2002/0084882 | A1 | 7/2002 | Moro | |
| 2002/0097124 | A1 * | 7/2002 | Inoue et al. | 336/83 |
| 2003/0001718 | A1 | 1/2003 | Inoue et al. | |
| 2003/0156000 | A1 | 8/2003 | Brunner | |
| 2004/0074564 | A1 | 4/2004 | Brunner | |
| 2005/0007232 | A1 | 1/2005 | Ono et al. | |

FOREIGN PATENT DOCUMENTS

| | | | | |
|---|---|---|---|---|
| EP | 1 150 312 | A2 | | 10/2001 |
| GB | 1 494 078 | A | | 12/1977 |
| GB | 2 379 558 | A2 | | 3/2003 |
| JP | 1-321607 | A | | 12/1989 |
| JP | 3-96202 | A | | 4/1991 |
| JP | 6-267758 | A | | 9/1994 |
| JP | 8-236331 | A | | 9/1996 |
| JP | 9-306715 | A | | 11/1997 |
| JP | 10-92625 | A | | 4/1998 |
| JP | 2001-185421 | A | | 7/2001 |
| SU | 707672 | A | * | 1/1980 |
| WO | WO 01/91141 | A1 | | 11/2001 |
| WO | WO 03/043033 | A1 | | 5/2003 |

* cited by examiner

COIL COMPONENT AND FABRICATION METHOD OF THE SAME

BACKGROUND OF THE INVENTION

This invention relates to a coil component and the fabrication method thereof. In particular, this invention relates to the coil component which is used as a reactor in a high-power system such as an energy control of a battery mounted on an electrically-powered car or a hybrid car including an electromotor and an internal-combustion engine.

In an electrically-powered car or a hybrid car, the coil component is driven at frequencies within the audibility range of the human ear. Specifically, the normal driving frequency of the coil component in the electrically-powered car or the hybrid car belongs to a frequency range of from several kilohertz to several tens kilohertz.

The driving frequency of the audibility range has a possibility of undesired vibration which is caused by mutual forces of attraction between coil wires or between a coil and a magnetic core. The undesired vibration makes an audible noise or whine. In addition, if the coil component has an air-gap, the coil component further has a possibility of undesired vibration caused by mutual forces of attraction between portions of the core which is provided with the air-gap. Note here that, according to the conventional techniques, there is no magnetic core structure which does not become saturated even upon a DC bias of 200 A or more without air-gaps. In other words, at least one air-gap is an absolute necessity for a superior DC bias characteristic over 200 A or more.

A known coil component is disclosed in JP-A 2001-185421. The disclosed coil component is used for a low-power and high-frequency system. The disclosed coil component comprises a coil and first and second magnetic core members. The first magnetic core member includes magnetic metal powder of 50-70%, by volume, and thermosettable resin of 50-30%, by volume. The second magnetic core member is a dust core made of sintered ferrite body or magnetic metal powder. The first and the second magnetic core members are magnetically connected in series. The coil is embedded in the first magnetic core member.

One of the purposes of JP-A 2001-185421 is to provide a magnetic component such as an inductor, a choke coil and a transformer, which can suppress noise occurrence when the magnetic component is driven.

However, note here that the actual target frequency of JP-A 2001-185421 seems to belong to a range of from several hundreds of kilohertz to several megahertz as disclosed in paragraph [0006] of JP-A 2001-185421. The target frequency of JP-A 2001-185421 far exceeds the audible frequencies. It should be also known that the high-frequency vibration of the coil component at its air-gap does not make an audible noise or whine. Therefore, it is reasonable to assume that JP-A 2001-185421 directs its attention to another noise occurrence mechanism which is quite different from the present invention.

In addition, the target of JP-A 2001-185421 is a downsized coil component for low-power system. As a matter of course, the structure of the coil component disclosed in JP-A 2001-185421 is weak in the properties of withstand voltage and resistance to undesired pulses such as surge currents.

Thus, it is conceivable that the coil component of JP-A 2001-185421 is not suitable for the high-power and low-frequency system.

SUMMARY OF THE INVENTION

It is an object of the present invention to provide a coil component which has a property of high withstand voltage and another property of resistance to undesired pulses and can suppress the whine of the coil component driven even at the audible frequency, and to provide a fabrication method thereof.

According to an aspect of the present invention, a coil component comprises: a coil-containing insulator enclosure obtainable by enclosing a coil, except for end portions of the coil, with an insulator which comprises at least first resin; and a magnetic core made of a mixture of a second resin and powder, which comprises at least magnetic powder, wherein at least one part of the coil-containing insulator enclosure is embedded in the magnetic core.

An appreciation of the objectives of the present invention and a more complete understanding of its structure and a fabrication method thereof may be had by studying the following description of the preferred embodiment and by referring to the accompanying drawings.

DESCRIPTION OF PREFERRED EMBODIMENTS

With reference to FIGS. 1 to 10, a coil component 100 according to a first embodiment of the present invention comprises a coil-containing insulator enclosure 60 and a magnetic core 80. In this embodiment, the coil-containing insulator enclosure 60 is completely embedded in the magnetic core 80.

Figure 4:
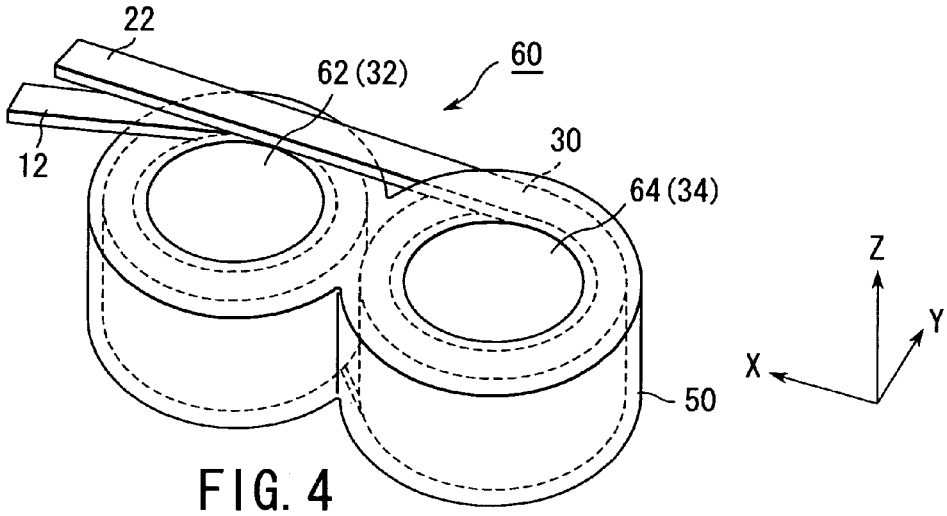
FIG. 4 is a perspective view showing the coil-containing insulator enclosure which is made according to the process of FIG. 3.
Figure 5:
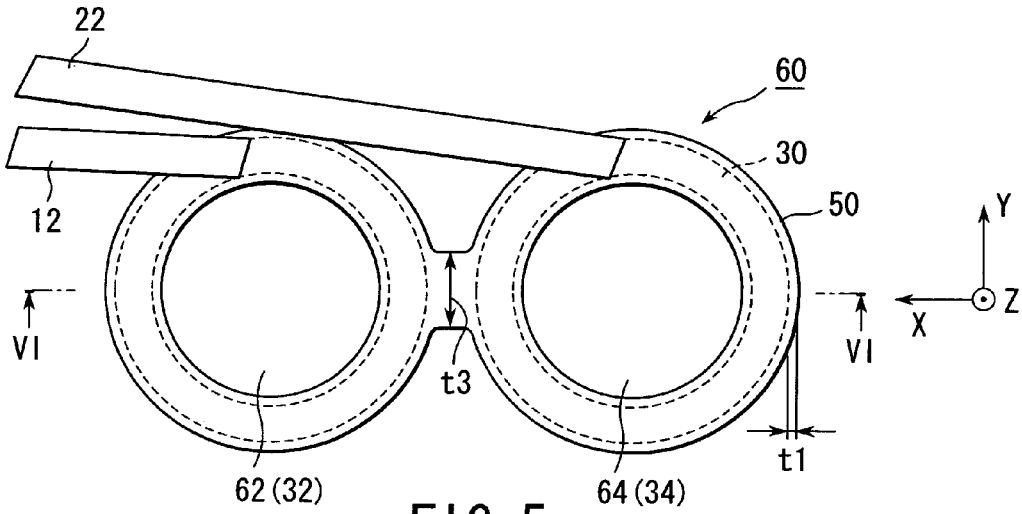
FIG. 5 is a top plan view showing the coil-containing insulator enclosure of FIG. 4.
Figure 6:
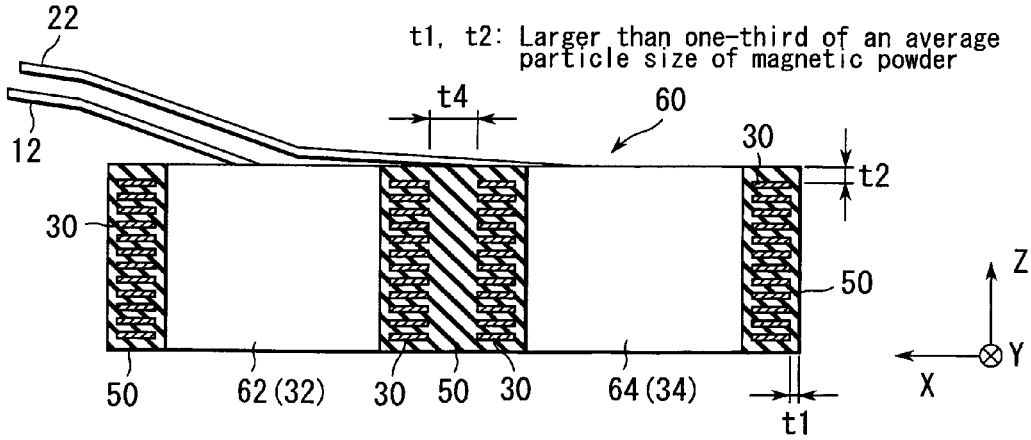
FIG. 6 is a cross-sectional view showing the coil-containing insulator enclosure of FIG. 5.

As shown in FIGS. 4 to 6, the coil-containing insulator enclosure 60 has a structure obtainable by enclosing a coil 30 with an insulator 50, except for end portions 12, 22 of the coil 30.

Figure 1:
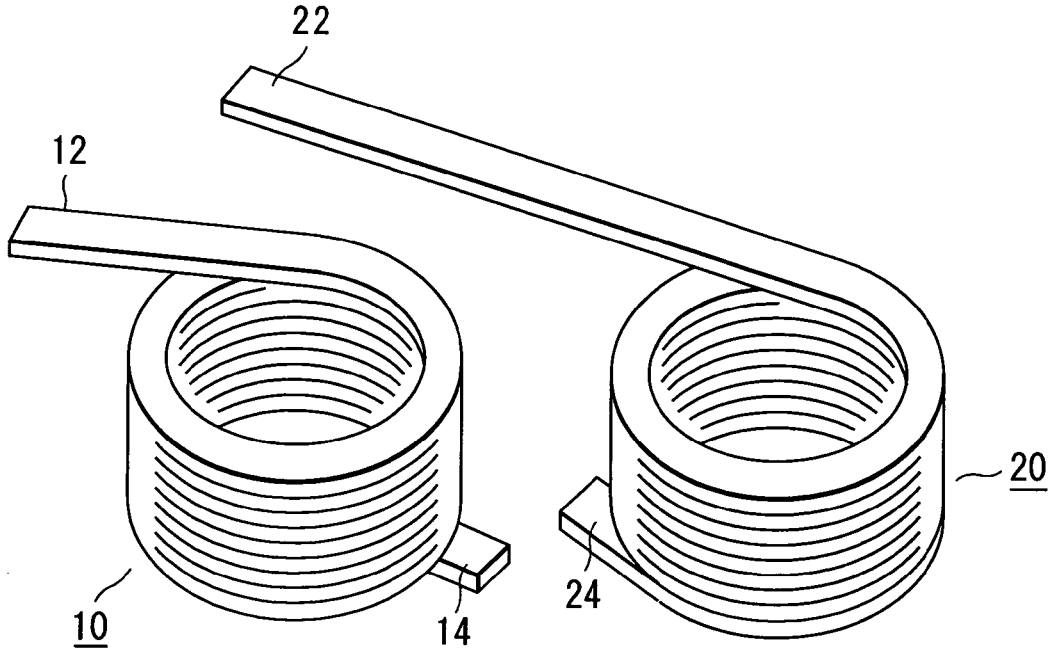
FIG. 1 is a perspective view showing a set of coil members included in a coil component according to a first embodiment of the present invention.
Figure 2:
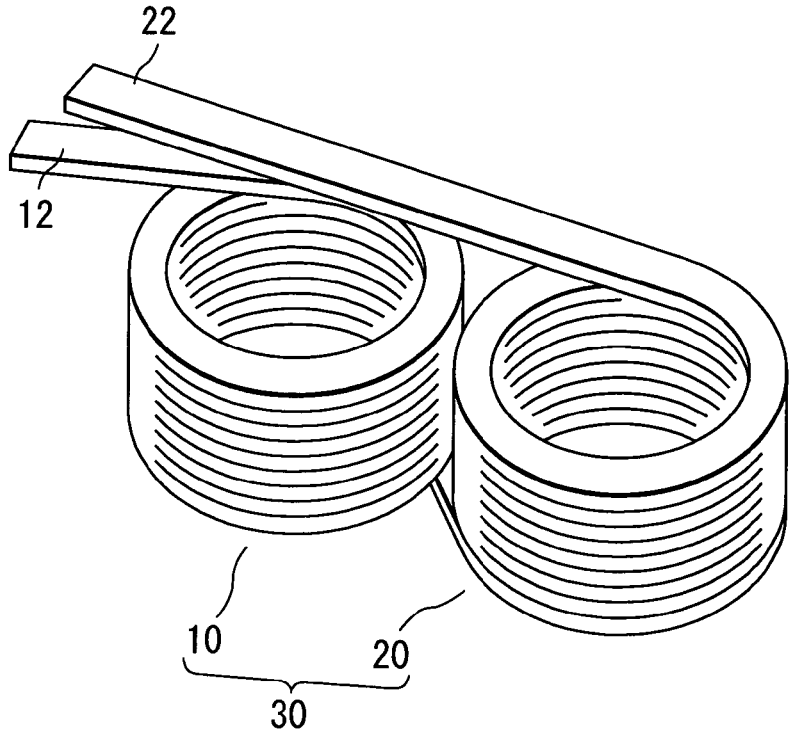
FIG. 2 is a perspective view showing a coil which is formed of the coil members shown in FIG. 1.

As seen from FIGS. 1 and 2, the coil 30 of the present embodiment has a spectacles- or glasses-shaped structure or a figure eight structure which is obtained by connecting two coil members 10, 20. Each of the coil members 10, 20 is an edgewise-wound coil obtainable by winding a flat type wire edgewise. The coil member 10 has two end portions 12, 14. Likewise, the coil member 20 has two end portions 22, 24. The coil 30 is obtained by connecting the end portions 14, 24 of the coil members 10, 20 with each other. In detail, the coil 30 has the structure where the coil members 10, 20 are arranged so that the axial directions of the coil members 10, 20 are parallel to each other and the coil members 10, 20 form one magnetic path. In other words, when an electrical current flows from the end portion 12 to the end portion 22 by way of the connection point of the end portions 14, 24, the coil members 10, 20 generate magnetomotive forces which go toward the opposite directions; the magnetomotive forces generated of the coil members 10, 20 are connected to each other to form a single magnetic path. In this embodiment, the coil 30 is made of the combination of the discrete coil members 10, 20. However, a similar shape of the coil may be obtained by winding a single flat type wire.

Figure 3:
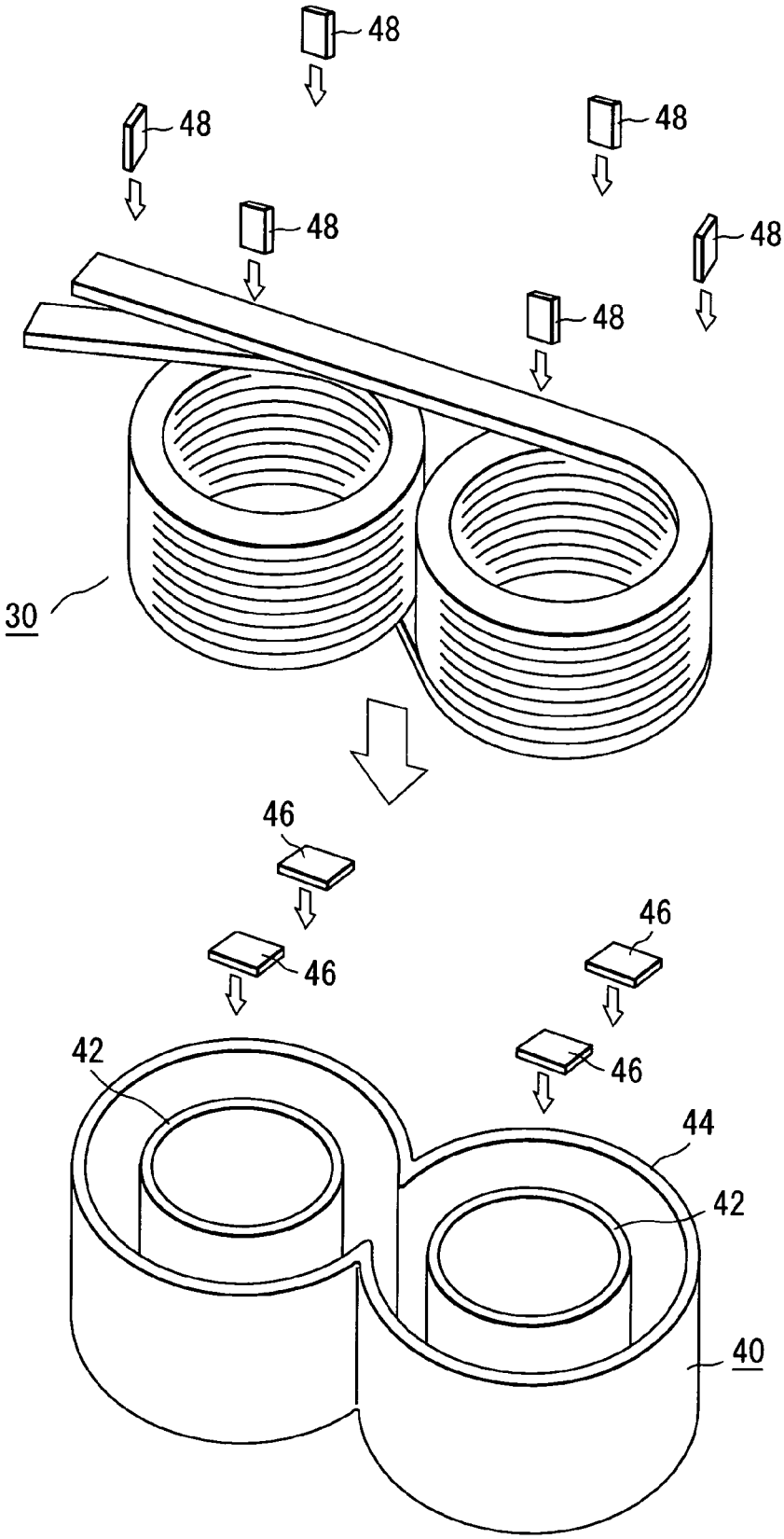
FIG. 3 is a perspective view showing a manufacturing process of a coil-containing insulator enclosure included in the coil component of the first embodiment.

By using the coil 30, the coil-containing insulator enclosure 60 is obtained in accordance with a manufacturing process as illustrated in FIG. 3. With reference to FIG. 3, it can be understood that a temporal container 40 is at first selected in consideration of the structure and the shape of the coil-containing insulator enclosure 60. The temporal container 40 has two inner cylindrical projections 42 and an outer wall portion 44 which has a cross-section of figure eight. The outer wall portion 44 and inner cylindrical projections 42 are connected by a bottom portion of the temporal container 40.

On the bottom portion, first insulator spacers 46 are disposed. The first insulator spacers 46 are made of the same material as the insulator 50, the material being explained in detail afterwards. Each of the first insulator spacers 46 has almost the same thickness as that of the insulator 50 of the coil-containing insulator enclosure 60 in the axial direction of the coil 30. The thickness of the insulator 50 of the coil-containing insulator enclosure 60 in the axial direction of the coil 30 is shown with a reference "t2" in FIG. 6.

After the first insulator spacers 46 are disposed on the bottom portion of the temporal container 40, the coil 30 is mounted on the first insulator spacers 46 to position the coil 30 within the temporal container 40 in its vertical direction in consideration of the thickness t2 of the insulator 50. As apparently understood from the above description and the drawing, the first insulator spacers 46 serve to position the coil 30 only in the vertical direction, i.e. the axial direction of the coil 30.

To position the coil 30 within the horizontal direction of the coil-containing insulator enclosure 60, second insulator spacers 48 are inserted between the radially-peripheral part of the coil 30 and the inner side surface of the temporal container 40. Each of the second insulator spacers 48 has almost the same thickness as that of the insulator 50 of the coil-containing insulator enclosure 60 in the radial direction of the coil 30. The thickness of the insulator 50 of the coil-containing insulator enclosure 60 in the radial direction of the coil 30 is shown with a reference "t1" in FIGS. 5 and 6.

After the coil 30 is horizontally and vertically positioned within the temporal container 40 by the use of the first and the second insulator spacers 46, 48, the material of the insulator 50 is filled between the coil 30 and the temporal container 40.

In this embodiment, the insulator 50 is made of epoxy resin. Hereinafter, the resin of the insulator 50 is referred to as "first resin".

In this embodiment, the epoxy resin is required to be liquid which has a small coefficient of viscosity. Therefore, the mutual solubility of resin and additives, hardenings or catalysts and the lifetime of the resin, in particular, are important items to be considered in deciding the actual epoxy resin. Based on the considerations, it is preferable that the base compound is selected from the group of bisphenol A epoxy resin, bisphenol F epoxy resin, polyfunctional epoxy resin and so on, while the hardener or curing agent is selected from the group of aromatic polyamine system, carboxylic anhydride system, initiative hardener system and so on. In this embodiment, bisphenol A epoxy resin is selected as a base compound of the first resin, and low-viscosity solventless aromatic amine liquid is selected as a hardener for the first resin.

The first resin may be another thermosettable resin such as silicone resin. Also, the resin may be another curable or hardenable resin such as light-curable or photo-settable resin, ultraviolet curable resin, chemical-reaction curable resin, or the like.

When the first resin of the insulator 50 is cast in the temporal container 40 and then is hardened, the coil-containing insulator enclosure 60 is obtained as shown in FIGS. 4 to 6.

As seen from FIGS. 4 to 6, the coil-containing insulator enclosure 60 comprises two hollow portions 62, 64, which correspond two hollow portions 32, 34 of the coil 30, respectively. The insulator 50 of the coil-containing insulator enclosure 60 has a thickness t3 in the Y-direction, which is a direction perpendicular to the arrangement direction of the coil members 10, 20. The insulator 50 of the coil-containing insulator enclosure 60 has a thickness t4 in the X-direction, which is the arrangement direction of the coil members 10, 20.

Figure 7:
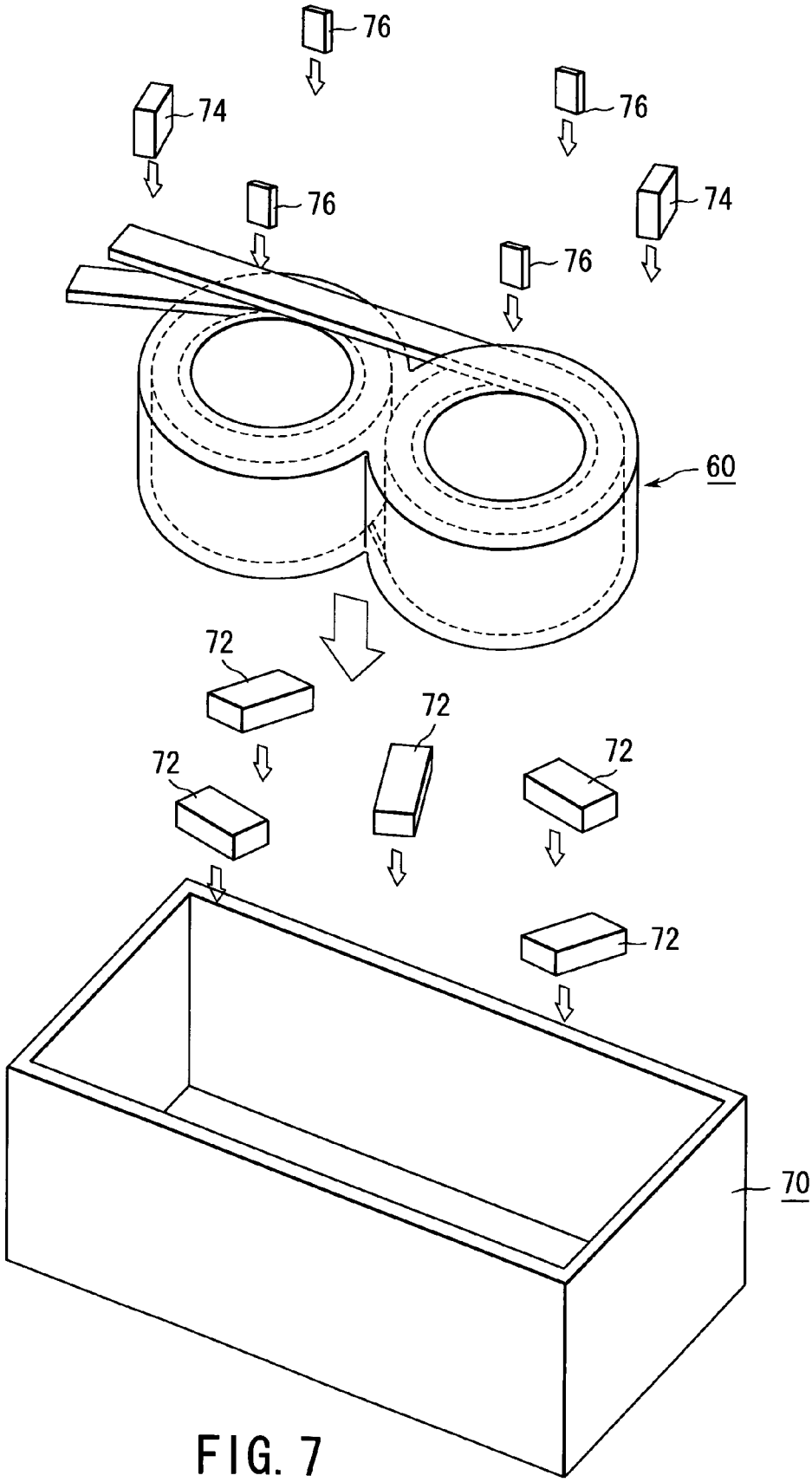
FIG. 7 is a perspective view showing a manufacturing process of the coil component of the first embodiment.

The thus obtained coil-containing insulator enclosure 60 is positioned and arranged within a case 70 as illustrated in FIG. 7.

The positioning members are spacers made of the same material as that of the magnetic core 80. Because the magnetic core 80 is made of a mixture of resin and magnetic powder as described in detail afterwards, the spacers are referred to as mixture spacers, hereinafter. Furthermore, the resin included in the mixture is referred to as a second resin in distinction from the first resin of the insulator 50. In this embodiment, the second resin is however the same resin as the first resin in material. If the second resin is the same resin as the first resin, the coil-containing insulator enclosure 60 and the magnetic core 80 can be easily and suitably formed in a single object when the coil-containing insulator enclosure 60 is embedded in the magnetic core 80.

With reference to FIG. 7, first mixture spacers 72 are disposed on the bottom portion of the case 70, and then the coil-containing insulator enclosure 60 is mounted on the first mixture spacers 72 so that the coil-containing insulator enclosure 60 is vertically positioned within the case 70. Next, second and third mixture spacers 74, 76 are inserted between the coil-containing insulator enclosure 60 and the inner side surface of the case 70 so that the coil-containing insulator enclosure 60 is also horizontally positioned. The size and the shape of each of the first to the third mixture spacers 72, 74, 76 is selected as appropriate in consideration of the arrangement and the position of the coil-containing insulator enclosure 60 in connection with the magnetic core 80. In this embodiment, the size and the shape of each of the first to the third mixture spacers 72, 74, 76 is selected so that the coil-containing insulator enclosure 60 is completely embedded in the magnetic core 80 as illustrated in FIGS. 8 to 10.

Figure 8:
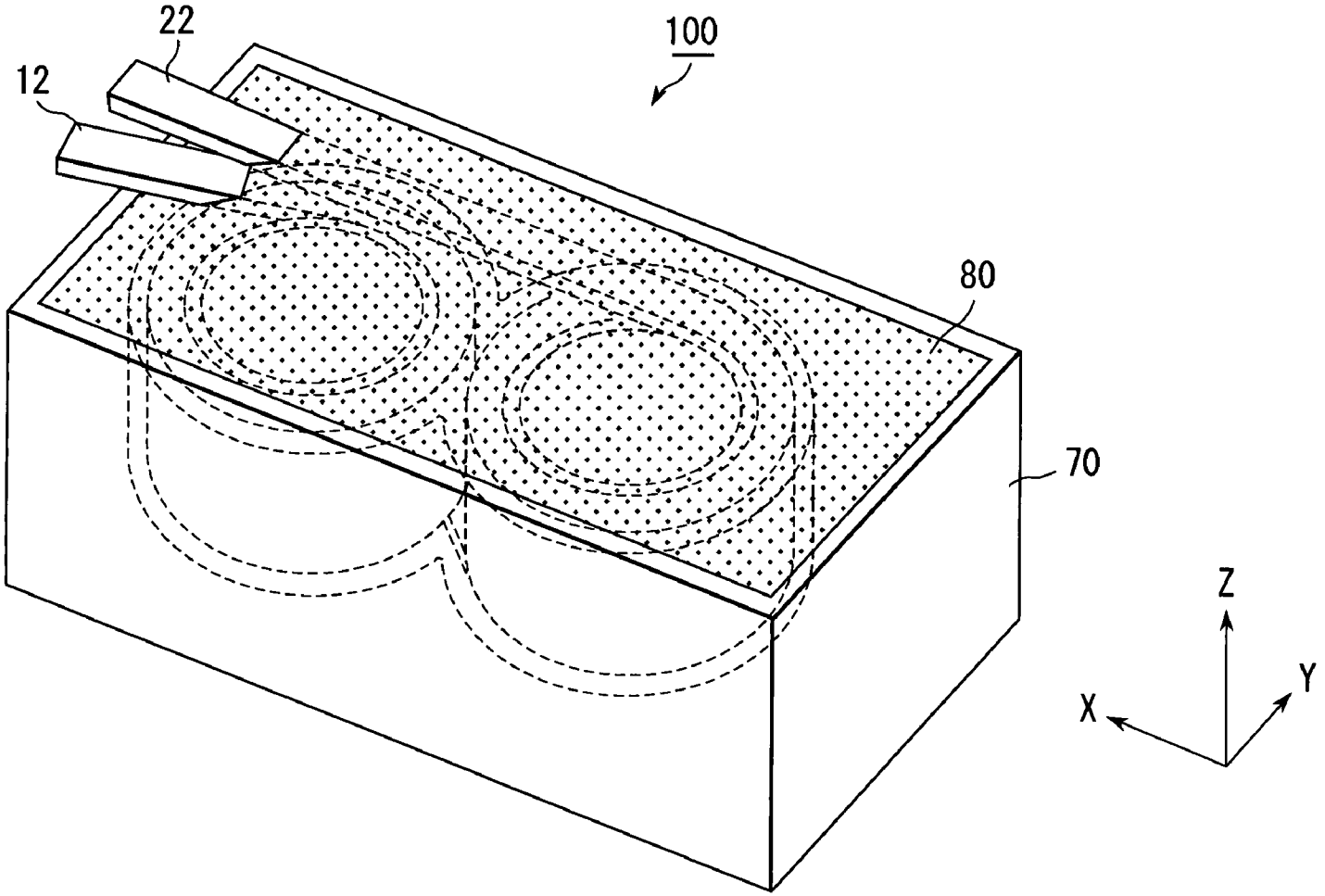
FIG. 8 is a perspective view showing the coil component of the first embodiment.
Figure 9:
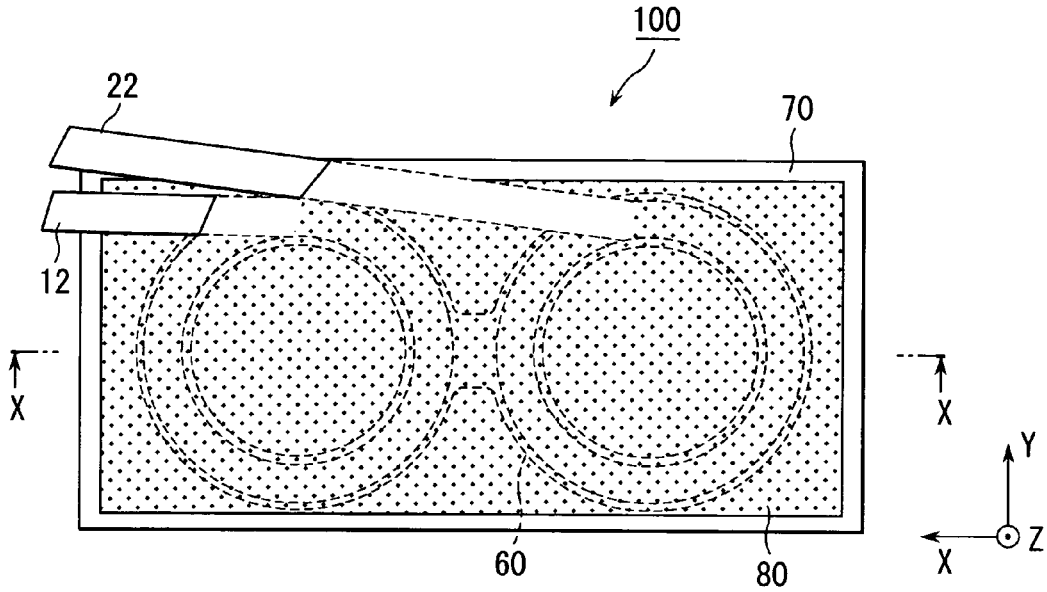
FIG. 9 is a top plan view showing the coil component of FIG. 8.
Figure 10:
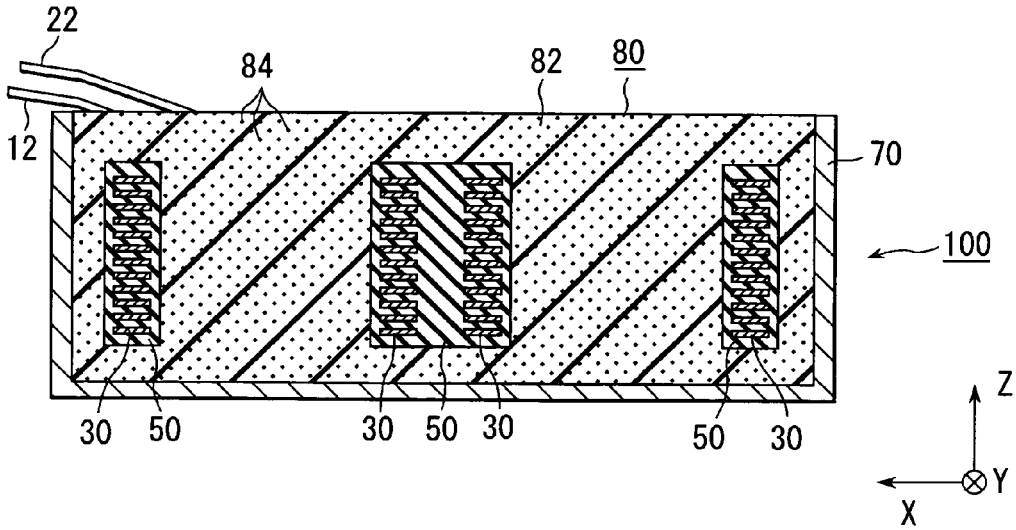
FIG. 10 is a cross-sectional view showing the coil component of FIG. 9.

After the coil-containing insulator enclosure 60 is horizontally and vertically positioned in the case 70 by the use of the first to the third mixture spacers 72, 74, 76, the mixture of the second resin 82 and the magnetic powder 84 is cast in the case 70 to be filled between the case 70 and the coil-containing insulator enclosure 60 as illustrated in FIGS. 8 to 10. After that, the second resin 82 is hardened so that the magnetic core 80 of the present embodiment can be obtained.

As apparently from the above description, the magnetic core 80 of the embodiment is a casting, which is obtainable by casting the mixture into a predetermined shaped container for molding. In consideration of the size of the high-power coil component, it is preferable that the mixture 20 is composed of the materials which are capable of casting without any solvents.

In this embodiment, the casting process is basically carried out without pressure or with reduction of pressure. Once the casting process is finished, the casting may be subjected to some pressure for the purpose of increasing the density of the magnetic core according to the present embodiment. There is no limitation on the mold shape, and the magnetic core 80 of the mixture can be formed in any shapes.

The magnetic powder 84 is soft magnetic metal powder, especially, Fe base powder in this embodiment. Specifically, the Fe base powder is powder selected from the group comprising Fe—Si system powder, Fe—Si—Al system powder, Fe—Ni system powder and Fe system amorphous powder. In case of Fe—Si system powder, an average content of Si is preferably in a range of from 0.0 percent, by weight, to 11.0 percents, by weight, both inclusive. In case of Fe—Si—Al system powder, an average content of Si is preferably in a range of from 0.0 percent, by weight, to 11.0 percents, by weight, both inclusive; while another average content of Al is preferably in a range of from 0.0 percent, by weight, to 7.0 percents, by weight, both inclusive. In case of Fe—Ni system powder, an average content of Ni is in a range of from 30.0 percents, by weight, to 85.0 percents, by weight, both inclusive.

In this embodiment, the magnetic powder 84 is substantially spherical powder, which can be obtained by, e.g., gas atomization. The spherical or the almost spherical powder is suitable for increasing its filling factor or filling ratio in the mixture of the magnetic powder 84 and the second resin 82. In this embodiment, it is recommended that the spherical or the almost spherical powder has an average diameter of 500 μm or less as the most normal diameter in its particle size distribution. The magnetic powder 84 may be non-spherical powder such as powder obtained by another intentional gas atomization or indefinitely-shaped powder obtained by water atomization, when its anisotropy is used. If the magnetic powder 84 of non-spherical powder or indefinitely-shaped powder is used, the mixture of the magnetic powder 84 and the second resin 82 is subjected to an anisotropic alignment under the predetermined magnetic field before the mixture becomes completely hardened.

In consideration of fluidity of the mixture of the second resin 82 and the magnetic powder 84, the mixing ratio of the second resin 82 in the mixture is in a range of from 20 percents, by volume, to 90 percents, by volume, both inclusive. Preferably, the mixing ratio is in a range of from 40 percents, by volume, to 70 percents, by volume, both inclusive.

The magnetic core 80 has an elastic modulus of 3000 MPa or more. The second resin 82 is selected such that, in case of the magnetic core 80 has the foregoing elastic modulus of 3000 MPa or more under a specific condition, the second resin 82 has an elastic modulus of 100 MPa or more if only the second resin 82 is hardened in accordance with the specific condition. The value of the elastic modulus of the magnetic core 80 or the hardened second resin 82 is measured in accordance with a standard of measurement called JIS K6911 (Testing methods for thermosetting plastics).

In this embodiment, the magnetic core 80 has the elastic modulus of 15000 MPa. The second resin 82 is selected such that the hardened second resin 82 has 1500 MPa if only the second resin 82 is hardened under the same condition where the mixture is hardened to have the elastic modulus of 15000 MPa. When the magnetic core 80 has the elastic modulus of 15000 MPa or more, its thermal conductivity drastically becomes better. Specifically the thermal conductivity becomes 2 [$WK^{-1}m^{-1}$]. Therefore, it is preferable that the magnetic core 80 has the elastic modulus of 15000 MPa or more.

Figure 19:
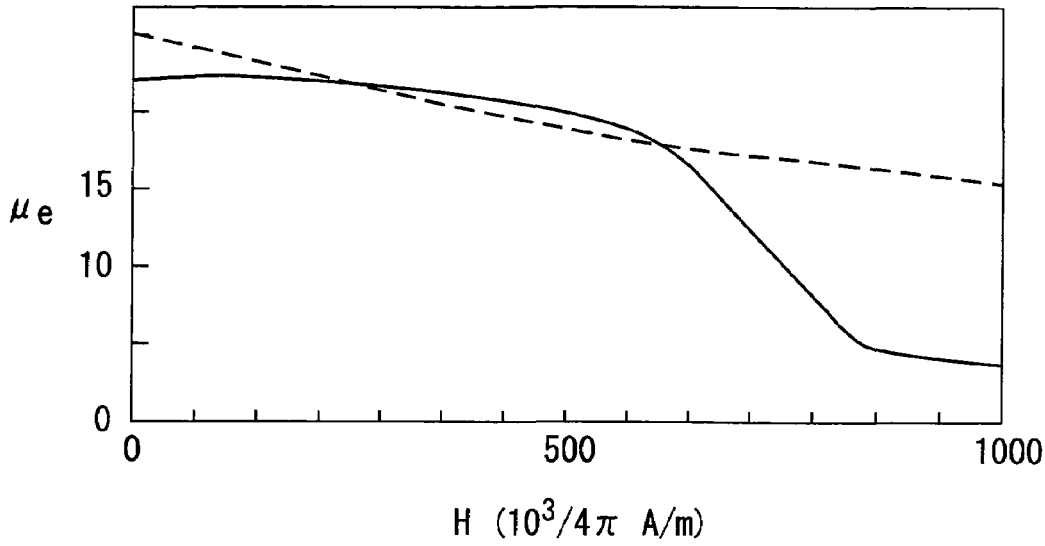
FIG. 19 is a graph showing a DC bias characteristic of a magnetic core used in the coil component according to the embodiment of the present invention, wherein the magnetic core is made of a mixture of resin and magnetic powder.

FIG. 19 shows a DC bias characteristic of the magnetic core 80 made of the mixture of Fe—Si system powder 84 and epoxy resin 82. The mixing ratio of the epoxy resin in the mixture is 50 percents, by volume. Namely, the Fe—Si system powder has mixing ratio of 50 percents, by volume. From FIG. 19, it is clearly seen that the DC bias characteristic of the mixture of the embodiment does not drastically saturated and has high relative permeability $\mu_e$ over fifteen even at a magnetic field of $1000*10^3/4\pi$[A/m].

The above-mentioned magnetic core 80 can be modified as far as the magnetic core 80 has relative permeability of 10 or more at a magnetic field of $1000*10^3/4\pi$[A/m]. For example, each of particles of the magnetic powder 84 may be provided with a high permeability thin layer, such as a Fe—Ni base thin layer. The high permeability thin layer is formed on a surface of each particle of the magnetic powder 84. Also, each of particles of the magnetic powder 84 may be coated with at least one insulator layer in advance of the mixing of the magnetic powder 84 and the second resin 82. In case of the magnetic powder particle with the high permeability thin layer, the insulator layer is formed on the high permeability thin layer. The mixture of the second resin 82 and the magnetic powder 84 may further include non-magnetic filler such as filler selected from the group comprising glass fiber, granular resin, and inorganic material base powder, which includes silica powder, alumina powder, titanium oxide powder, silica glass powder, zirconium powder, calcium carbonate powder and aluminum hydroxide powder. Also, the mixture of the second resin 82 and the magnetic powder 84 may include a small amount of permanent magnetic powder.

The insulator 50 may include non-magnetic filler. The non-magnetic filler included in the insulator 50 is selected such that at least one of an elastic modulus and a linear expansion coefficient of the mixture hardened corresponds to that of the hardened insulator 50. The non-magnetic filler may be filler selected from the group comprising glass fiber, granular resin, and inorganic material base powder, which includes silica powder, alumina powder, titanium oxide powder, silica glass powder, zirconium powder, calcium carbonate powder and aluminum hydroxide powder.

It is preferable that the non-magnetic filler added to the insulator 50 is substantially spherical powder. It is also preferable that the spherical or the almost spherical non-magnetic powder has an average diameter of 500 μm or less as the most normal diameter in its particle size distribution.

In consideration of fluidity of the insulator 50 before the insulator 50 is hardened, the mixing ratio of the first resin in the insulator 50 is 30 percents, by volume, or more. Preferably, if the high magnetic reluctance of the insulator 50 is used as described later, the ratio of the first resin is in a range of from 30 percents, by volume, to 50 percents, by volume, both inclusive. In other words, it is preferable that the content of the non-magnetic filler in the insulator 50 is 50 percents, by volume, or more.

In order to ensure better insulation effect, it is preferable that each of the thicknesses t1, t2 and t4 shown in FIGS. 5 and 6 is larger than the one-third of an average particle size d1 of the magnetic powder 84, i.e.: $t1>d1/3$; $t>d1/3$; and $t4>d1/3$. Similarly, it is preferable that each of the thicknesses t1, t2 and t4 shown in FIGS. 5 and 6 is larger than the one-third of an average particle size d2 of the non-magnetic filler, i.e.: $t1>d2/3$; $t>d2/3$; and $t4>d2/3$. Furthermore, to prevent a short-path mode due to ineffective magnetic fluxes in the magnetic circuit, it is preferable to meet the following inequality: $t3 \geqq t4 \geqq d2/3$.

The case 70 of this embodiment is made of aluminum alloy. The case 70 may be made of other metal or alloy such as Fe—Ni alloy. In case of the metal case 70, it is preferable that an insulator film is formed on an inner surface of the metal case 70 before the mixture of the second resin 82 and the magnetic powder 84 is cast in the metal case 70. Furthermore, the case may be a ceramic case such as an alumina mold.

In this embodiment, the magnetic core 80 and the coil-containing insulator enclosure 60 are fixed to the case 70. However, the present invention is not limited thereto. For example, in the manufacturing process of the coil component 100 of the present invention, the case 70 may be formed of fluorocarbon polymers sheets, and the mixture may be cast in the case made of fluorocarbon polymers sheets. When the fluorocarbon polymers sheets are removed from the hardened mixture, the coil component without the case can be obtained and can be freely arranged within an existing case.

Next explanation will be made about a coil component according to a second embodiment of the present invention, with reference to FIGS. 11 to 15. The coil component of the present embodiment has a structure similar to that of the coil component 100 of the first embodiment.

Figure 13:
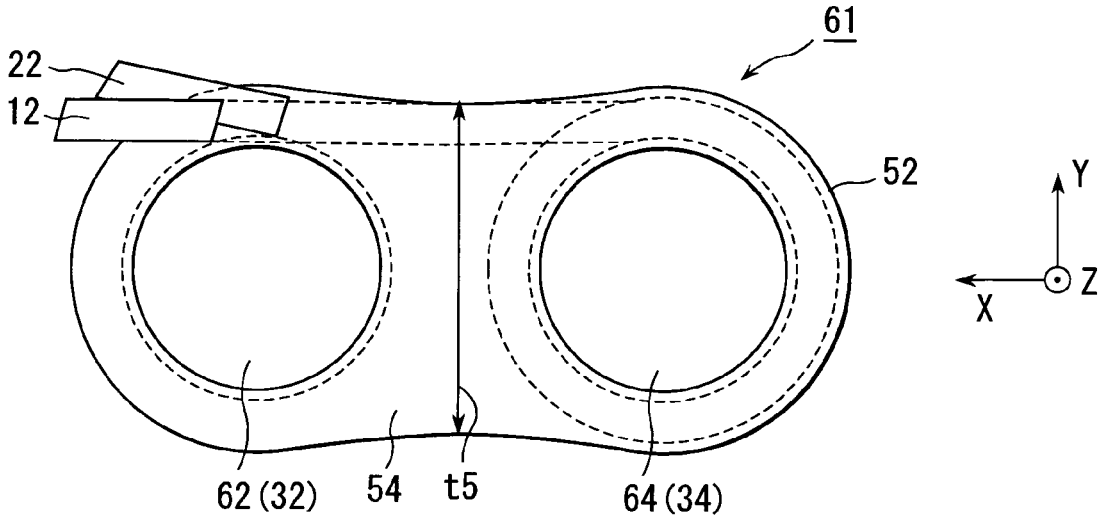
FIG. 13 is a top plan view showing the coil-containing insulator enclosure of FIG. 12.

As seen from FIGS. 13 and 5, only the shape of the coil-containing insulator enclosure 61 is different from the coil-containing insulator enclosure 60 of the first embodiment. Specifically, the Y-directional thickness t5 of the coil-containing insulator enclosure 61 between the coil members is much larger than the thickness t3 of the same part of the coil-containing insulator enclosure 60 of the first embodiment. The portion of the thickness t5 has a same effect that a high magnetic reluctance region 54 is placed between the coil members of the coil 30.

Figure 14:
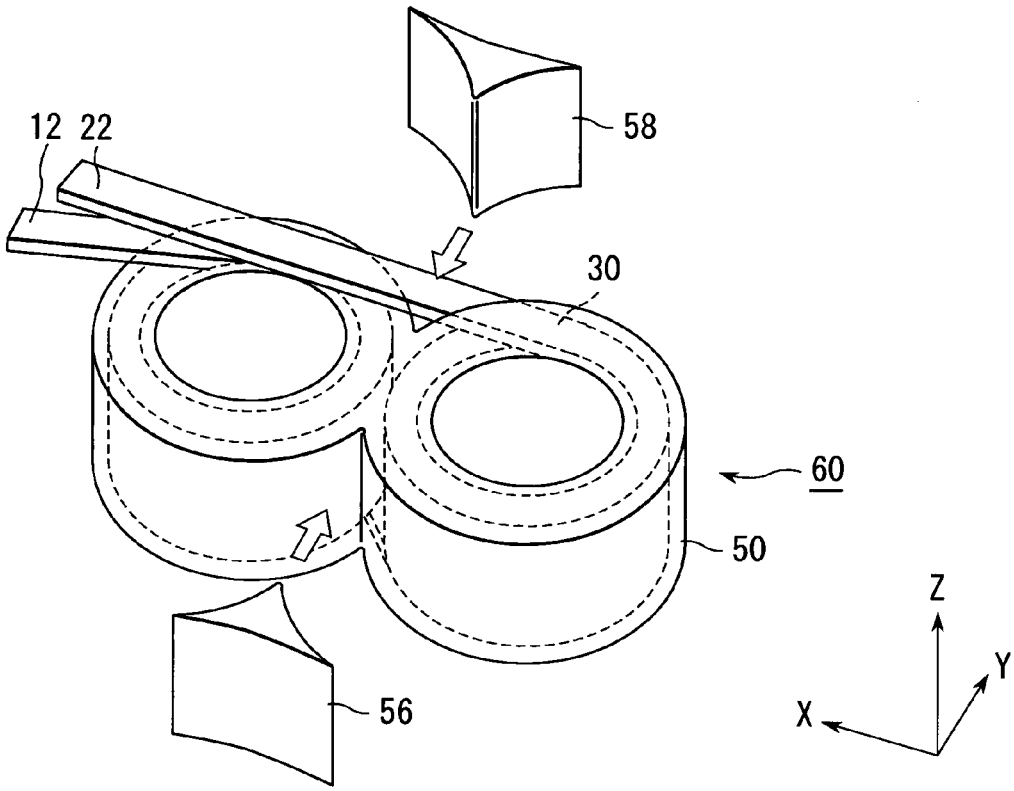
FIG. 14 is a perspective view for use in describing the structure of the coil-containing insulator enclosure of FIG. 12.
Figure 15:
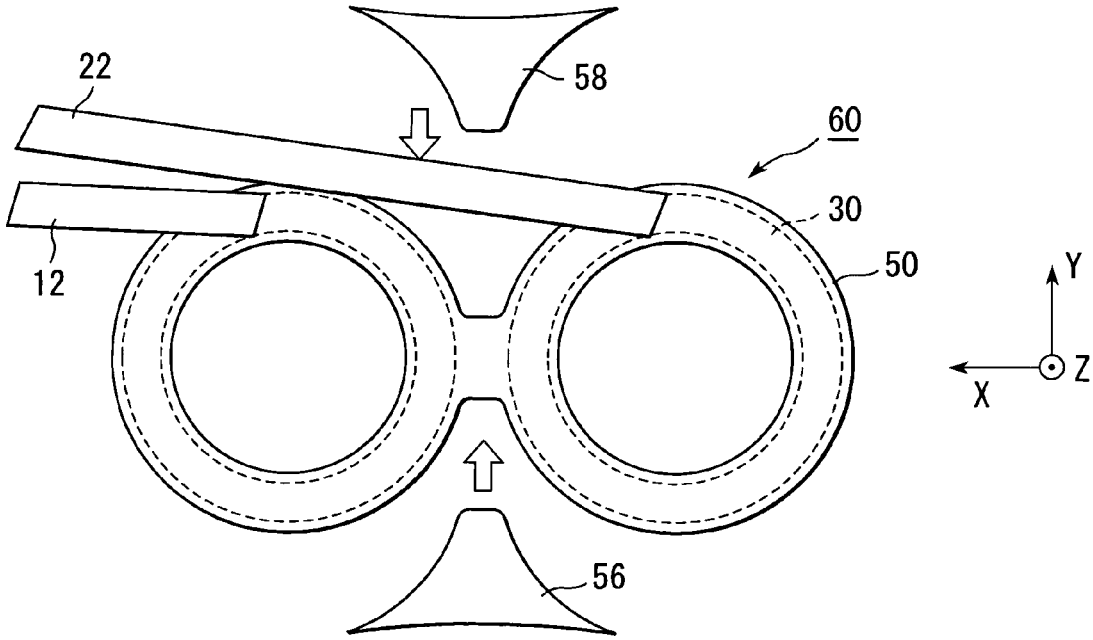
FIG. 15 is a top plan view for use in describing the structure of the coil-containing insulator enclosure of FIG. 12.

In other words, two high magnetic reluctance regions 56, 58 are added to the coil-containing insulator enclosure 60 of the first embodiment in the Y-direction, as illustrated in FIGS. 14 and 15. Each of the high magnetic reluctance regions 56, 58 extends along the axial direction of the coil 30. The high magnetic reluctance regions 56, 58 are positioned between the coil members in the X-direction. The existence of the high magnetic reluctance regions 56, 58 provides a good result that the magnetic fluxes caused by each coil member effectively pass through the center portion of the other coil member.

Figure 11:
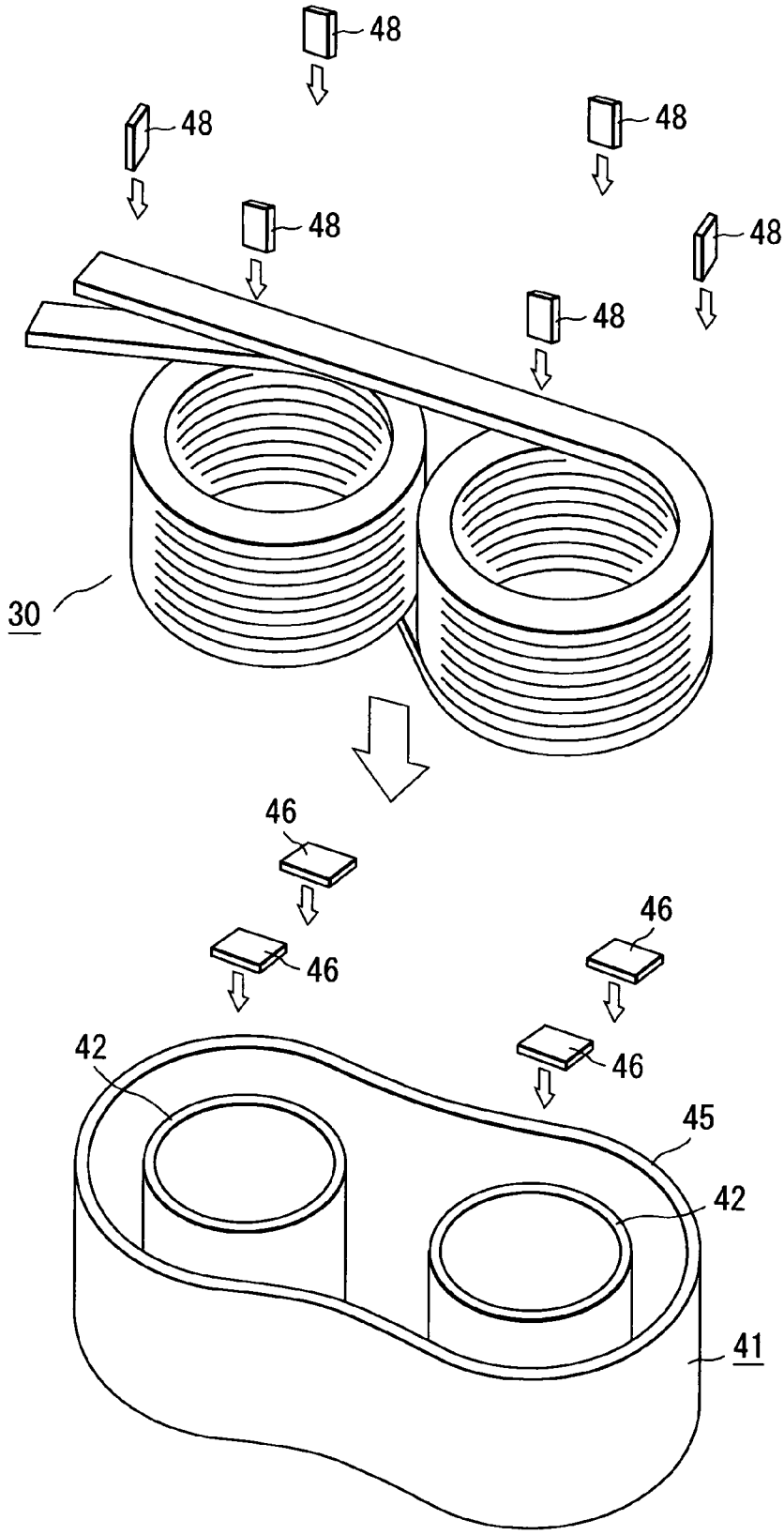
FIG. 11 is a perspective view showing a manufacturing process of a coil-containing insulator enclosure included in a coil component in accordance with a second embodiment of the present invention.
Figure 12:
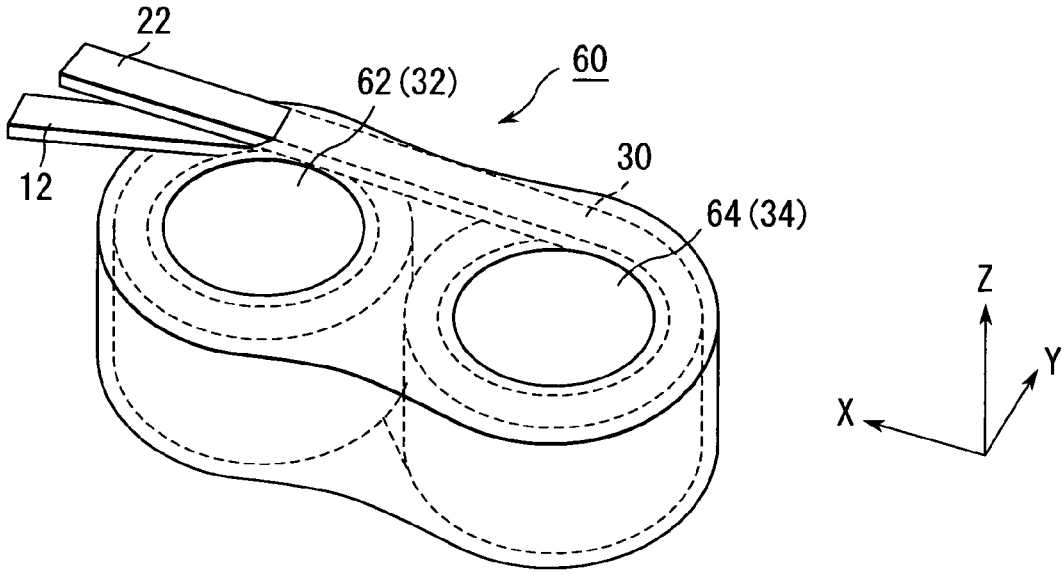
FIG. 12 is a perspective view showing the coil-containing insulator enclosure which is made according to the process of FIG. 11.

According to the present embodiment, the high magnetic reluctance region 54(56, 58) can be easily obtained by selecting the shape of the temporal container 41 as shown in FIG. 11. The temporal container 41 has an outer wall portion 45, which has a shape like a running track or like an oval. The high magnetic reluctance region 54 may be formed by separately preparing two high magnetic reluctance members (56, 58), followed by adhering the high magnetic reluctance members (56, 58) to the predetermined positions of the coil-containing insulator enclosure 60 of the first embodiment. However, the coil-containing insulator enclosure 61 has an advantage of low cost.

Next explanation will be made about a coil component 110 of a third embodiment of the present invention, with reference to FIGS. 16 to 18. The coil component 110 of the present embodiment has a structure where high magnetic reluctance members 90 are added to the coil component 100 of the first embodiment, wherein the high magnetic reluctance members 90 each has a magnetic reluctance higher than the magnetic core 80 made of the mixture and are inserted into the magnetic path formed in the coil component 100.

In this embodiment, each of the high magnetic reluctance members 90 is made of the same material as the insulator 50 and constitutes a high magnetic reluctance region which has relative permeability of 20 or less within the magnetic core 80 made of the mixture. The high magnetic reluctance member 90 may be made of another material comprising the same resin as the first resin. Also, the high magnetic reluctance member 90 may be made of another material comprising the same resin as the first resin and other non-magnetic filler which is not used in the insulator 50. In addition, the high magnetic reluctance member 90 may be made of another material comprising the same resin as the first resin and magnetic powder as far as the high magnetic reluctance member 90 has the magnetic reluctance higher than the magnetic core.

Figure 18:
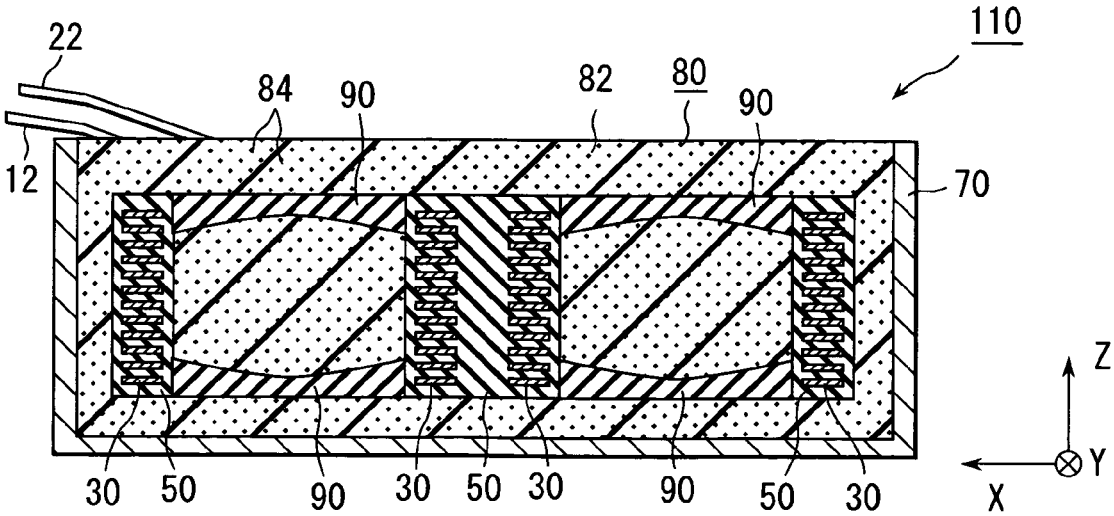
FIG. 18 is a cross-sectional view showing the coil component of the third embodiment, which includes the high magnetic reluctance members of FIGS. 16 and 17.

As shown in FIG. 18, each of the high magnetic reluctance members 90 is placed within the hollow portion 62, 64 and is completely embedded in the magnetic core 80. Also, as seen from FIG. 18, a pair of the high magnetic reluctance members 90 is arranged parallel to each other with in one of the hollow portions 62, 64.

Each of the high magnetic reluctance members 90 may be positioned by forming the high magnetic reluctance members 90 in advance and by putting each of the high magnetic reluctance members 90 at the predetermined positions on the mixture when the mixture reaches the suitable level during the casting process of the mixture.

Figure 16:
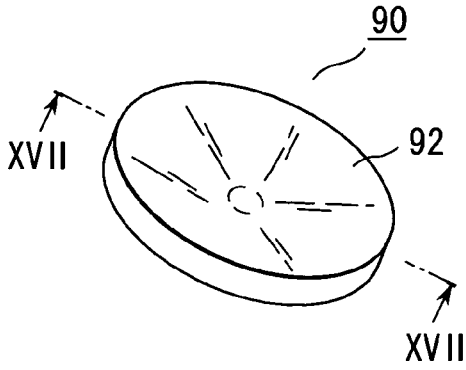
FIG. 16 is a perspective view showing a high magnetic reluctance member included in a coil component in accordance with a third embodiment of the present invention.
Figure 17:
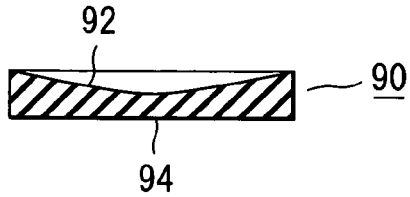
FIG. 17 is a cross-sectional view showing the high magnetic reluctance member of FIG. 16.

As shown in FIGS. 16 and 17, each of the high magnetic reluctance members 90 has a shape like a concave lens, which has a concave surface 92 and a flat surface 94. The high magnetic reluctance member 90 may have another shape in which a peripheral part of the high magnetic reluctance member 90 is larger in thickness than a central part of the high magnetic reluctance member 90. In other words, the high magnetic reluctance member 90 can be modified as far as the peripheral part of the high magnetic reluctance member 90 is thicker than the central part of the high magnetic reluctance member 90. Furthermore, the high magnetic reluctance member 90 may be a disc with parallel surfaces but this shape of the high magnetic reluctance member has a small effect in averaging the distribution of the magnetic flux density.

The above-mentioned embodiments can be modified as followings.

Figure 20:
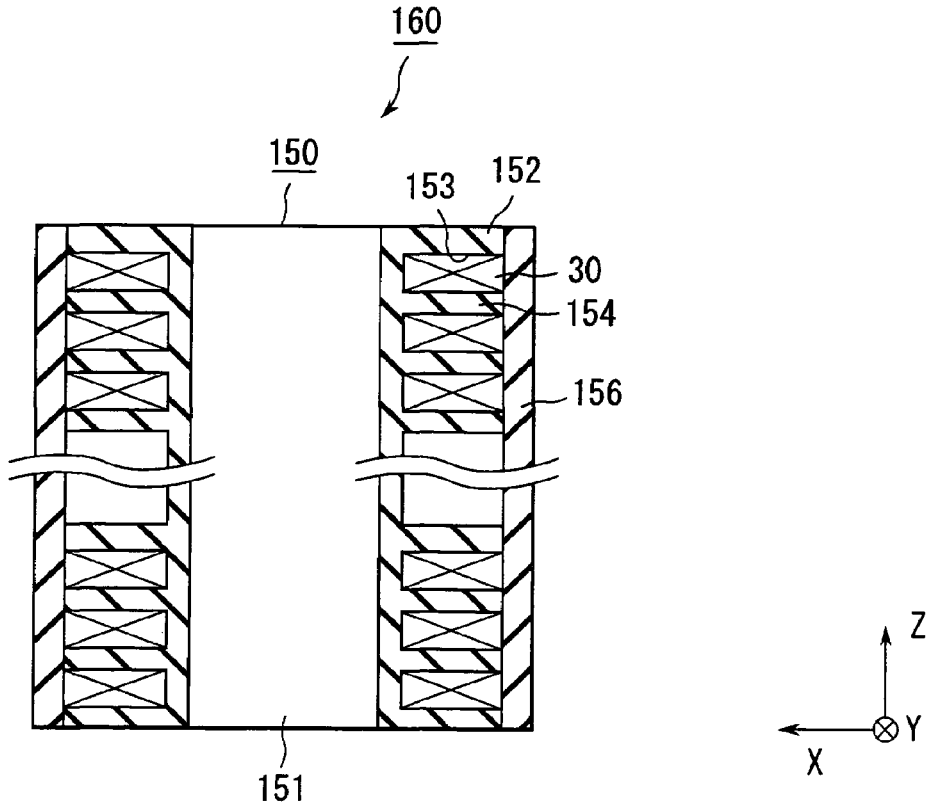
FIG. 20 is a cross-sectional view showing another coil-containing insulator enclosure which includes a bobbin and a cover in accordance with an embodiment of the present invention.

As shown in FIG. 20, the coil 30 may be enclosed by an insulator 150 to ensure insulation between turns of the coil 30. In other words, the coil-containing insulator enclosure 160 may comprise the insulator 150 and the coil 30. The illustrated insulator 150 has a profile of an almost cylindrical shape with a hollow portion 151 and comprises a bobbin 152 and a cylindrical cover 156. The bobbin 152 has on its peripheral part thereof a spiral groove 153. Neighboring spiral turns of the groove 153 constitute the separations 154 of the turns of the coil 30. The coil 30 is accommodated in a space defined by the spiral groove 153 and the cylindrical cover 156. Thus, the insulator 150 suitably insulates the coil 30 from other things, e.g., another coil, and ensures the insulation between the turns of the coil 30. Preferably, the material of the insulator 150 is the same resin as the second resin of the mixture.

Figure 21:
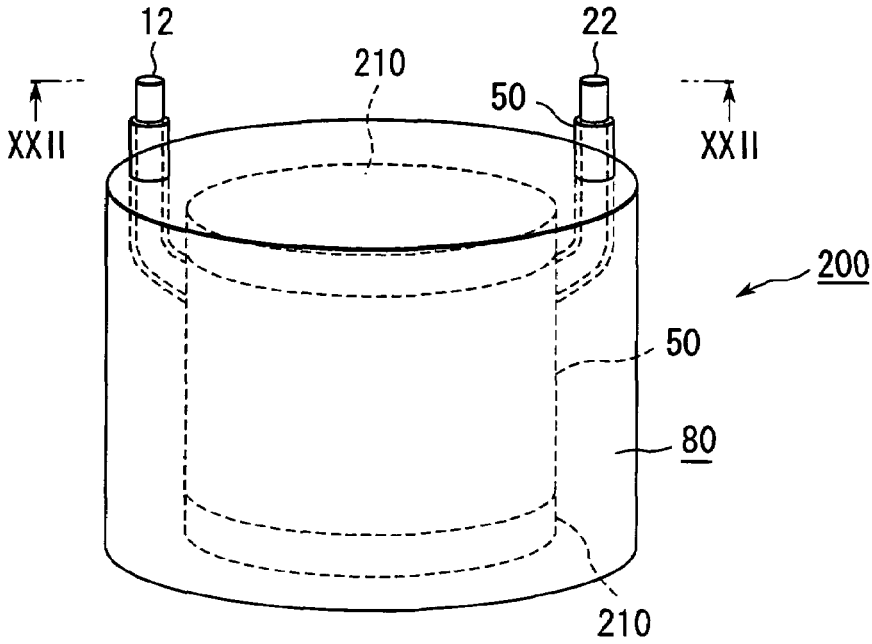
FIG. 21 is a perspective view showing another coil component according to an embodiment of the present invention.
Figure 22:
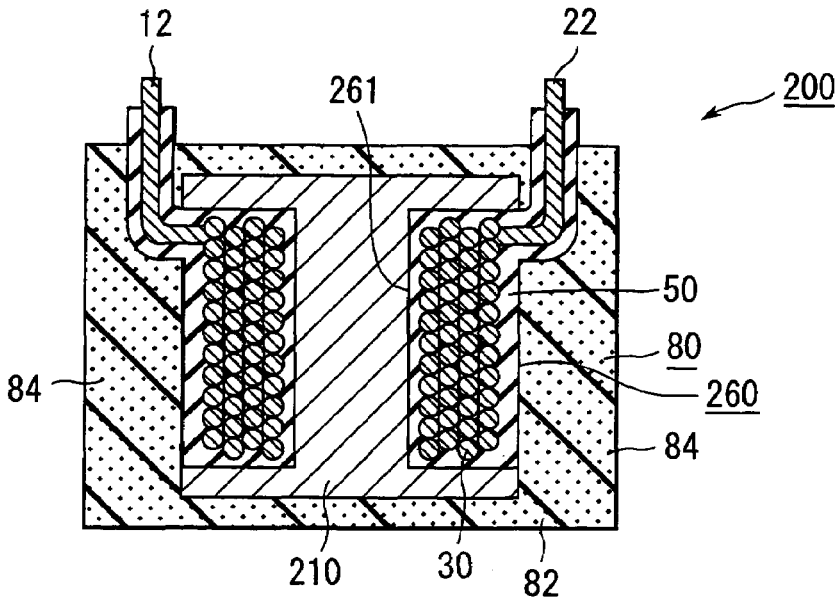
FIG. 22 is a cross-sectional view showing the coil component of FIG. 21.

As shown in FIGS. 21 and 22, the conventional dust core or the laminated core may be used as a part of the magnetic path in the coil component. In detail, the coil component 260 comprises a specific magnetic core member 210 disposed within the hollow portion 261 of the coil-containing insulator enclosure 260. The specific magnetic core member 210 may be disposed around the coil-containing insulator enclosure 260. The specific magnetic core ember 210 is fixed to the coil-containing insulator enclosure 260 by means of the magnetic core 80 made of the mixture.

An example of the specific magnetic core member 210 is a dust core made of powder selected from the group comprising Fe system amorphous powder, Fe—Si system powder, Fe—Si—Al system powder and Fe—Ni system powder, or a laminated core made of Fe base thin sheets.

The coil 30 illustrated in FIG. 22 is a solenoid coil but may be an edgewise coil like a coil member 10, 20 shown in FIG. 1, or may be another type coil such as a toroidal coil.

In the above-mentioned embodiments, the positioning processes of the coil 30 and the coil-containing insulator enclosure 60, 61 use the insulator spacers 46, 48 and the mixture spacers 72, 74, 76, respectively. However, if the coil 30 has high stiffness, the coil 30 and the coil-containing insulator enclosure 60, 61 can be positioned, without using the insulator spacers 46, 48 and the mixture spacers 72, 74, 76, but by holding only the end portions 12, 22 of the coil 30. The coil 30 and the coil-containing insulator enclosure 60, 61 may be hanged and positioned by the use of fluorocarbon polymer fibers.

The preferred embodiments of the present invention will be better understood by those skilled in the art by reference to the above description and figures. The description and preferred embodiments of this invention illustrated in the figures are not to intend to be exhaustive or to limit the invention to the precise form disclosed. They are chosen to describe or to best explain the principles of the invention and its applicable and practical use to thereby enable others skilled in the art to best utilize the invention.

While there has been described what is believed to be the preferred embodiment of the invention, those skilled in the art will recognize that other and further modifications may be made thereto without departing from the sprit of the invention, and it is intended to claim all such embodiments that fall within the true scope of the invention.

What is claimed is:

1. A coil component comprising:

a coil-containing insulator enclosure obtained by enclosing a coil, except for end portions of the coil, with an insulator which comprises a first resin; and a magnetic core made of a mixture of a second resin and a powder, the powder comprises magnetic powder having particles, wherein at least one part of the coil-containing insulator enclosure is embedded in the magnetic core, the coil comprising a plurality of turns of a conductor, the turns being stacked along a predetermined direction with each space between neighboring turns being filled with the insulator, wherein the insulator has a first thickness in a radial direction of the coil and a second thickness in an axial direction of the coil; and each of the first and the second thicknesses is larger than one-third of an average particle size of the magnetic powder, the insulator further comprises a non-magnetic filler added to the first resin, the coil comprising two coil members each having an axis, the coil members being arranged so that the axes of the coil members are parallel to each other, the insulator comprising a connection portion between the coil members, the connection portion having a third thickness between the coil members in a first direction perpendicular to the axial direction, the connection portion having a fourth thickness in a second direction perpendicular to the axial direction and the first direction, the fourth thickness being equal to or more than the third thickness, the third thickness being one-third or more of an average particle size of the non-magnetic filler.

2. The coil component according to claim 1, wherein the coil-containing insulator enclosure is completely embedded in the magnetic core made of the mixture, except for the end portions of the coil.

3. The coil component according to claim 1, wherein the coil-containing insulator enclosure is an insulator casting obtained by casting material of the insulator.

4. The coil component according to claim 1, wherein the insulator comprises:

a bobbin which has, on a peripheral part thereof, a groove, wherein the coil is wound on the peripheral part of the bobbin to be held in the groove; and a cover which covers the peripheral part of the bobbin, wherein the coil is accommodated in a space formed between the groove and the cover.

5. The coil component according to claim 1, wherein the first resin and the second resin are one and the same kind of a curable or hardenable resin.

6. The coil component according to claim 1, wherein each of the first resin and the second resin is a thermosettable resin.

7. The coil component according to claim 1, wherein each of the particles of the magnetic powder is provided with a high permeability thin layer, which is formed on a surface of each particle of the magnetic powder.

8. The coil component according to claim 1, wherein each of the particles of the magnetic powder is coated with at least one insulator layer in advance of forming the mixture of the powder and the second resin.

9. The coil component according to claim 1, wherein a mixing ratio of the second resin in the mixture is in a range of from 20 percent by volume, to 90 percent, by volume, both inclusive.

10. The coil component according to claim 9, wherein the mixing ratio is in a range of from 40 percent, by volume, to 70 percent, by volume, both inclusive.

11. The coil component according to claim 1, wherein the second resin is an epoxy resin or a silicone resin.

12. The coil component according to claim 1, wherein the first resin is an epoxy resin or a silicone resin.

13. The coil component according to claim 1, wherein the magnetic powder is soft magnetic powder.

14. The coil component according to claim 13, wherein the soft magnetic powder is soft magnetic metal powder.

15. The coil component according to claim 14, wherein the soft magnetic metal powder is Fe—Si system powder.

16. The coil component according to claim 15, wherein an average content of Si in the Fe—Si system powder is in a range of from 0.0 percent, by weight, to 11.0 percent, by weight, both inclusive.

17. The coil component according to claim 14, wherein the soft magnetic metal powder is Fe—Si—Al system powder.

18. The coil component according to claim 17, wherein an average content of Si in the Fe—Si—Al system powder is in a range of from 0.0 percent, by weight, to 11.0 percent, by weight, both inclusive, and an average content of Al in the Fe—Si—Al system powder is in a range of from 0.0 percent, by weight, to 7.0 percent, by weight, both inclusive.

19. The coil component according to claim 14, wherein the soft magnetic metal powder is Fe—Ni system powder.

20. The coil component according to claim 19, wherein an average content of Ni in the Fe—Ni system powder is in a range of from 30.0 percent, by weight, to 85.0 percent, by weight, both inclusive.

21. The coil component according to claim 14, wherein the soft magnetic metal powder is Fe system amorphous powder.

22. The coil component according to claim 1, wherein the mixture includes a non-magnetic filler.

23. The coil component according to claim 1, wherein the magnetic core made of the mixture has a relative permeability of 10 or more in a magnetic field of $1000*10^3/4\pi$[A/m].

24. The coil component according to claim 1, wherein the insulator further comprises a non-magnetic filler added to the first resin; and wherein:

the non-magnetic filler is selected from the group consisting of a glass fiber, a granular resin and an inorganic material base powder, said inorganic material base powder being selected from the group consisting of alumina powder, titanium oxide powder, zirconium powder, calcium carbonate powder and aluminum hydroxide powder.

25. The coil component according to claim 24, wherein the non-magnetic filler is such that a linear expansion coefficient of the mixture when hardened corresponds to that of the insulator when hardened.

26. The coil component according to claim 24, wherein the non-magnetic filler is such that an elastic modulus of the mixture when hardened corresponds to that of the insulator when hardened.

27. The coil component according to claim 24, wherein the non-magnetic filler is substantially spherical powder.

28. The coil component according to claim 27, wherein the insulator has a first thickness in a radial direction of the coil and a second thickness in an axial direction of the coil; each of the first and the second thicknesses is larger than one-third of an average particle size of the magnetic powder; and each of the first and the second thicknesses is larger than one-third of an average particle size of the non-magnetic filler.

29. The coil component according to claim 24, wherein a ratio of the first resin in the insulator including the non-magnetic filler is in a range of 30 or more percent, by volume.

30. The coil component according to claim 1, wherein the coil-containing insulator enclosure has a hollow portion surrounded by the coil.

31. The coil component according to claim 30, further comprising a specific magnetic core member disposed around the coil-containing insulator enclosure and/or within the hollow portion of the coil-containing insulator enclosure, wherein the specific magnetic core member is fixed to the coil-containing insulator enclosure by means of the magnetic core made of the mixture.

32. The coil component according to claim 31, wherein the specific magnetic core member is a dust core made of powder selected from the group consisting of Fe system amorphous powder, Fe—Si system powder, Fe—Si—Al system powder and Fe—Ni system powder, or a laminated core made of Fe base thin sheets.

33. The coil component according to claim 30, further comprising a high magnetic reluctance member, which has a magnetic reluctance higher than the mixture and is embedded in the magnetic core made of the mixture.

34. The coil component according to claim 33, wherein the high magnetic reluctance member is made of a material comprising the same resin as the first resin.

35. The coil component according to claim 34, wherein the high magnetic reluctance member is made of the same material as the insulator.

36. The coil component according to claim 33, wherein the high magnetic reluctance member is placed within the hollow portion.

37. The coil component according to claim 36, comprising at least two of the high magnetic reluctance members, wherein the high magnetic reluctance members are arranged parallel to each other.

38. The coil component according to claim 36, wherein the high magnetic reluctance member has a shape in which a peripheral part of the high magnetic reluctance member is larger in thickness than a central part of the high magnetic reluctance member.

39. The coil component according to claim 33, wherein the high magnetic reluctance member constitutes a region which has a relative permeability of 20 or less within the magnetic core made of the mixture.

40. The coil component according to claim 30, wherein the magnetic core made of the mixture constitutes a loop of a magnetic path passing a center of the coil.

41. The coil component according to claim 1, wherein: the coil has a specific structure where at least two coil members are arranged so that axial directions of the coil members are parallel to each other and where neighboring ones of the coil members are connected to each other to form one magnetic path; and, between the neighboring ones of the coil members, there is formed a high magnetic resistance region which extends in a direction parallel to the axial directions of the coil members.

42. The coil component according to claim 41, wherein the high magnetic resistance region has a relative permeability of 20 or less.

43. The coil component according to claim 41, wherein the high magnetic resistance region is made of a material comprising the same resin as the first resin.

44. The coil component according to claim 43, wherein the high magnetic resistance region is made of the same material as the insulator.

45. The coil component according to claim 1, further comprising a case, wherein the coil-containing insulator enclosure is arranged within the case, and the magnetic core made of the mixture is filled between the coil-containing insulator enclosure and the case and encapsulates the coil-containing insulator enclosure therein.

46. The coil component according to claim 45, wherein the case comprises a metal container and an insulator layer formed on an inner surface of the metal container, or wherein the case comprises a ceramic container.

47. The coil component according to claim 46, wherein the metal container is made of aluminum or Fe—Ni alloy, or wherein the ceramic container is an alumina mold.

48. The coil component according to claim 1, wherein the magnetic core is a casting obtained by casting the mixture.

49. The coil component according to claim 48, wherein the mixture comprises materials which are capable of casting without any solvents.

50. A method of manufacturing a coil component according to claim 1, which comprises: a coil-containing insulator enclosure obtainable by enclosing a coil, except for end portions of the coil, with an insulator comprising at least a first resin; and a magnetic core made of a mixture of a second resin and powder comprising magnetic powder, the method comprising the steps of:

forming a mixture spacer from the mixture;

positioning the coil-containing insulator enclosure within a case by the use of the mixture spacer;

casting the mixture into the case; and hardening the mixture so that the coil-containing insulator enclosure is embedded in the magnetic core made of the mixture.

51. The method according to claim 50, further comprising the steps of:

forming an insulator spacer from the insulator;

positioning the coil within a temporal container by the use of the insulator spacer;

casting the insulator into the temporal container to enclose the coil, except for the end portions of the coil, with the insulator; and hardening the insulator to form the coil-containing insulator enclosure.

52. The method according to claim 50, wherein the coil-containing insulator enclosure has a hollow portion surrounded by the coil, and the method further comprises the steps of:

forming a high magnetic reluctance member from the insulator; and placing the high magnetic reluctance member within the hollow portion of the coil-containing insulator enclosure during the step of casting the mixture.

53. The coil component according to claim 1, wherein the magnetic powder is substantially a spherical powder.

54. The coil component according to claim 1, wherein the coil component is obtained by:

forming a mixture spacer from the mixture;

positioning the coil-containing insulator enclosure within a case by use of the mixture spacer;

casting the mixture into the case; and hardening the mixture so that the coil-containing insulator enclosure is embedded in the magnetic core made of the mixture.

* * * * *